US007824063B2

(12) United States Patent
Frick

(10) Patent No.: US 7,824,063 B2
(45) Date of Patent: Nov. 2, 2010

(54) KNURLED HANDGRIP FOR PORTABLE DEVICE

(75) Inventor: Markus W. Frick, Reno, NV (US)

(73) Assignee: Night Operations Systems, Reno, NV (US)

( * ) Notice: Subject to any disclaimer, the term of this patent is extended or adjusted under 35 U.S.C. 154(b) by 4 days.

(21) Appl. No.: 12/329,363

(22) Filed: Dec. 5, 2008

(65) Prior Publication Data

US 2009/0207601 A1 Aug. 20, 2009

Related U.S. Application Data

(62) Division of application No. 12/012,424, filed on Jan. 31, 2008.

(51) Int. Cl.
*F21L 4/04* (2006.01)

(52) U.S. Cl. ..... 362/202; 362/190; 362/208; 362/253; 16/421; 16/430

(58) Field of Classification Search ..... 362/190, 362/202, 208, 253; 16/421, 110.1, 430, 906; 294/25, 137, 139
See application file for complete search history.

(56) References Cited

U.S. PATENT DOCUMENTS

| | | | | |
|---|---|---|---|---|
| 2,373,306 | A * | 4/1945 | Gits | 362/203 |
| 4,876,632 | A | 10/1989 | Osterhout et al. | |
| 4,947,291 | A | 8/1990 | McDermott | |
| 5,072,347 | A | 12/1991 | Brunson | |
| 5,142,458 | A | 8/1992 | Brunson | |
| 5,144,207 | A | 9/1992 | Brunson | |
| 5,228,770 | A | 7/1993 | Brunson | |
| 5,345,370 | A * | 9/1994 | Murray et al. | 362/205 |
| 5,359,779 | A | 11/1994 | Polk et al. | |
| 5,604,406 | A | 2/1997 | Gaus | |
| 5,630,661 | A | 5/1997 | Fox | |
| 6,567,248 | B1 | 5/2003 | Schmidt et al. | |
| 6,624,585 | B2 | 9/2003 | Pruett | |
| 6,702,452 | B2 | 3/2004 | Jigamian et al. | |
| 6,761,467 | B2 | 7/2004 | Matthews et al. | |
| 6,854,865 | B2 | 2/2005 | Probst et al. | |
| 6,896,392 | B2 | 5/2005 | Jigamian et al. | |
| 6,909,250 | B2 | 6/2005 | Jigamian et al. | |
| 6,984,061 | B1 | 1/2006 | Soderberg et al. | |
| 2008/0055888 | A1 * | 3/2008 | Sharrah et al. | 362/106 |

* cited by examiner

*Primary Examiner*—Sandra L O'Shea
*Assistant Examiner*—Meghan K Dunwiddie
(74) *Attorney, Agent, or Firm*—SilverSky Group LLC

(57) ABSTRACT

The present invention is directed to lighting systems and illumination devices, and more particularly to a removable handle and battery pack for a portable lighting system that produces a high intensity beam of light in the visible and infrared spectral regions that can be used for non-covert and ultra-covert operations. The battery pack includes a 360 degree ballast connector, a locking, water-proof, recharge connector and plug, and a four-function back switch. The battery pack fits tightly into the redundantly sealed, water-proof handle, which includes a specially designed knurling system around the handle to improve a user's comfort and grip during extreme conditions and a rotatable D-ring connecter that locks in place and provides covert sound protection. The 360 degree ballast connector connects to a number of sealed connectors formed within a sealed ballast assembly.

33 Claims, 6 Drawing Sheets

FIG. 6
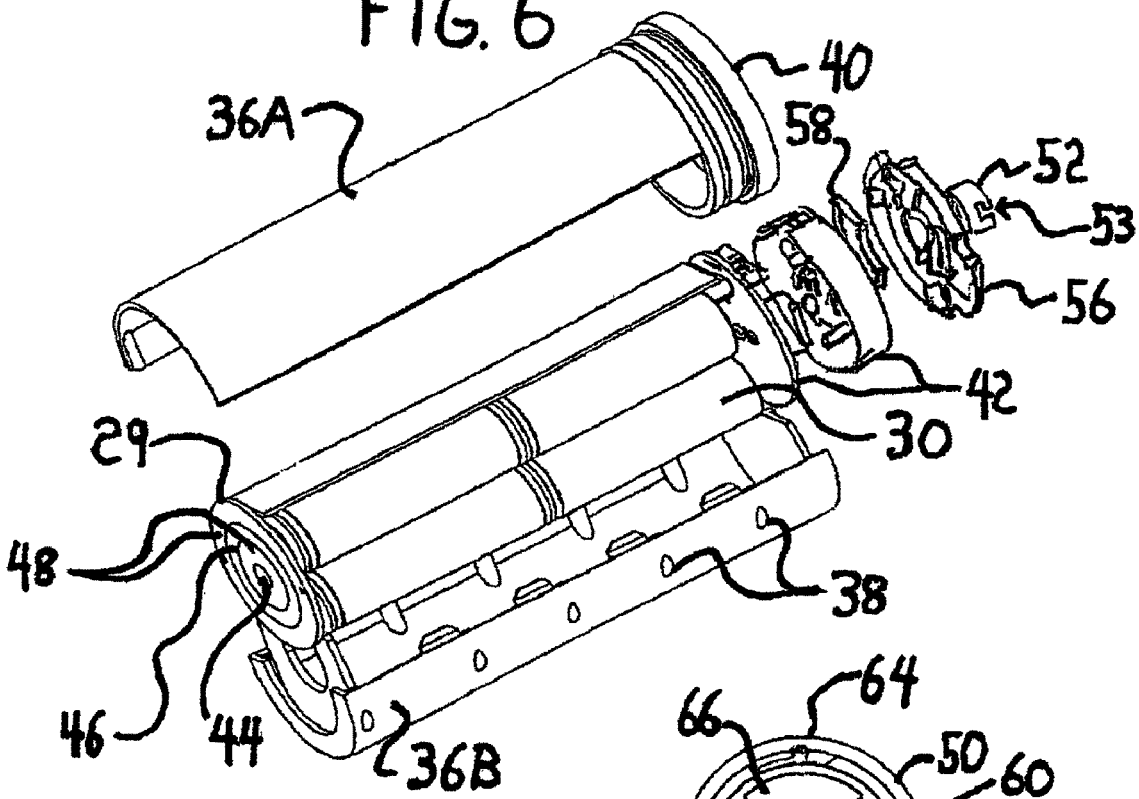
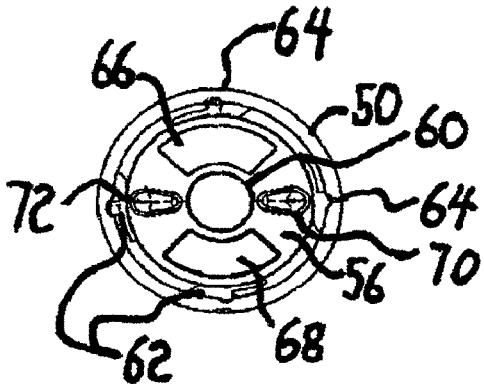
FIG. 7

FIG. 8
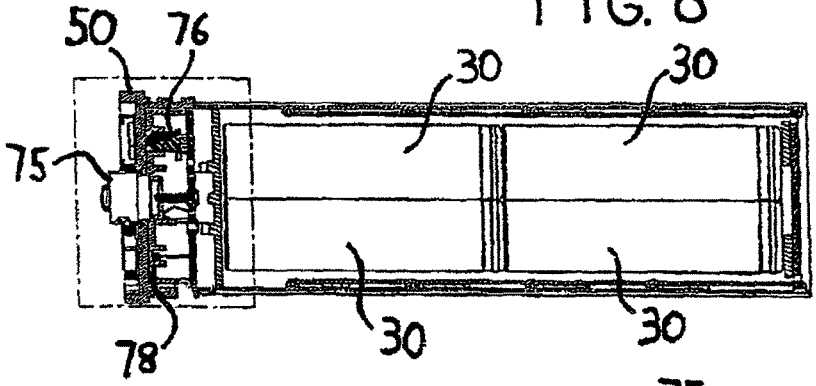
FIG. 9
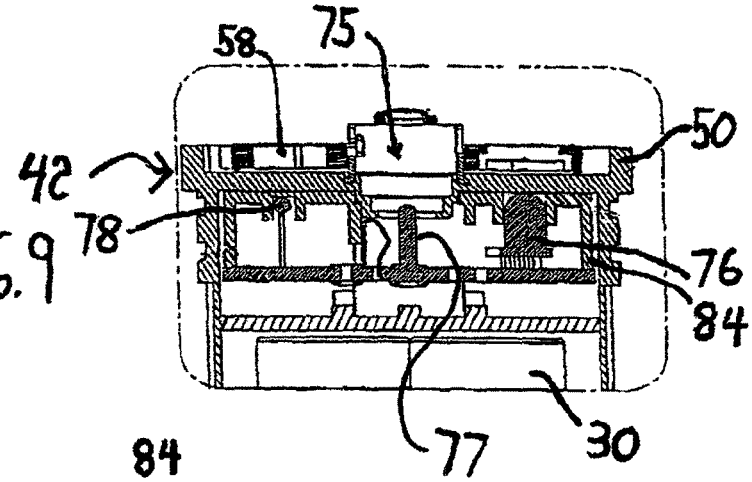
FIG. 10A
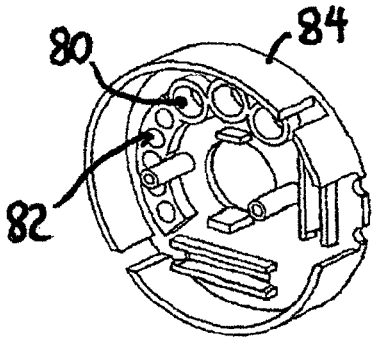
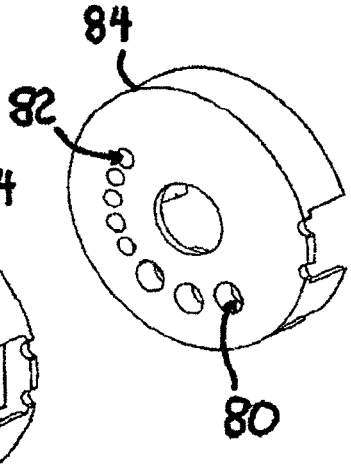
FIG. 10B

KNURLED HANDGRIP FOR PORTABLE DEVICE

CROSS-REFERENCES TO RELATED APPLICATIONS

This application is a division of and claims priority to U.S. patent application Ser. No. 12/012,424, filed 31 Jan. 2008.

BRIEF DESCRIPTION OF THE INVENTION

The present invention is directed to lighting systems and illumination devices, and more particularly to a removable handle and battery pack for a portable lighting system that produces a high intensity beam of light in the visible and infrared spectral regions that can be used for non-covert and ultra-covert operations. The battery pack includes a 360 degree ballast connector, a locking, water-proof, recharge connector and plug, and a four-function back switch. The battery pack fits tightly into the redundantly sealed, water-proof handle, which includes a specially designed knurling around the handle to improve a user's comfort and grip during extreme conditions and a rotatable D-ring connecter that locks in place and provides covert sound protection. The 360 degree ballast connector connects to a number of sealed connectors formed within a sealed ballast assembly.

STATEMENT AS TO THE RIGHTS TO INVENTIONS MADE UNDER FEDERALLY SPONSORED RESEARCH OR DEVELOPMENT

Not Applicable.

REFERENCE TO A "SEQUENCE LISTING," A TABLE, OR A COMPUTER PROGRAM LISTING APPENDIX SUBMITTED ON A COMPACT DISK

Not Applicable.

BACKGROUND OF THE INVENTION

High intensity discharge (HID) lights produce light by generating an electric arc across two spaced-apart electrodes housed inside a sealed quartz or alumina arc tube filled with gas or a mixture of gas and metals. The lamps of some HID lights include a third electrode within the arc tube that initiates the arc when the lamp is first lit. Other lights use a starting circuit referred to as an igniter, in place of the third electrode, that generates a high-voltage pulse to the electrodes to start the arc. Initially, the amount of current required to heat and excite the gases in the arc tube is high. Once the chemistry inside the arc tube reaches its "steady-state" operating condition, much less power is required. Since HID lights are negative resistance devices, they require an electrical ballast to provide a positive resistance or reactance that regulates the arc current flow and delivers the proper voltage to the arc during start-up and operation. The ballast is powered by a battery that is connected to the ballast.

U.S. Pat. No. 5,630,661, issued to Fox, illustrates a rechargeable metal arc flashlight with a battery that is connected to the ballast through multiple springs that appear to be part of the battery housing. U.S. Pat. No. 5,604,406 illustrates a portable metal halide light with three spring loaded contacts within the battery housing that transfer power from a power source to the flashlight's circuit board. U.S. Pat. Nos. 6,702,452, 6,896,392 and 6,909,250, all issued to Jigamian et al. ("Jigamian Patents"), illustrate a xenon arc search light with a field replaceable battery, but while it is stated that the battery can be removed from the rear of the lamp, no indication is given as to how the battery connects to the connectors that engage the lamp.

HID lights are ideal for lighting applications that require a beam of light that can travel great lengths to clearly illuminate distant objects, such as search lights, targeting lights, flash lights and other security, rescue, police and military applications. HID lights can also be useful in police and military applications. A HID light that produces infrared light is also useful in covert military operations, in cooperation with night vision goggles, to allow military personnel to see without being seen.

HID lights used in military and similar types of applications require a number of special features that are essential to the utility of the light and the safety of the light's user. Such lights need to be rugged and capable of withstanding sharp blows (as might occur when the lamp is dropped or used in hand-to-hand combat operations) and many different atmospheric conditions (fog, wind, water, dust, high heat and cold, etc.). The lamp and the battery need to be field replaceable, meaning that they can be easily swapped out in the field, without compromising the light, by a user, should the lamp break or a battery run too low on power. The light needs to be able to provide a number of different sources of light to fit appropriate circumstances. For example, the amount of light provided by the main lamp might be appropriate to illuminate a target, but would be inappropriate for use in reading a map.

The light also needs to be able to provide an early warning to a user that a battery is running low, so the light does not stop working at a bad time, i.e., during combat. While battery life indicators are known in handheld lights, such as that illustrated by U.S. Pat. No. 4,876,632, issued to Osterhout et al., a series of shining LED lights on the exterior of the housing are not always desirable, especially in covert operations.

BRIEF DESCRIPTION OF THE SEVERAL VIEWS OF THE DRAWING

FIG. 6 is a further exploded perspective view of the battery pack of FIG. 4;

FIG. 7 is an end view of the battery pack of FIG. 6;

FIG. 8 is a cross-sectional side view of the battery pack installed inside the handle and further illustrating a butt assembly in accordance with the present invention;

FIG. 9 is a more detailed cross-sectional view of the butt assembly of FIG. 6;

FIG. 10A is a first perspective view of a power indicator base in accordance with the present invention;

FIG. 10B provides a second perspective view of the power indicator base of FIG. 10A.

DETAILED DESCRIPTION OF THE INVENTION

The present invention is directed to a portable lighting system with a removable handle and battery pack that can be used in non-covert and covert operations. The battery pack includes a 360 degree ballast connector, a locking, water-proof, recharge connector and plug, and a four-function back switch. The battery pack fits tightly into the redundantly sealed, water-proof handle, which includes a specially designed knurling around the handle to improve a user's comfort and grip during extreme conditions and a rotatable D-ring connecter that locks in place and provides covert sound protection. The 360 degree ballast connector connects to a number of sealed connectors formed within a sealed ballast assembly.

Figure 1:
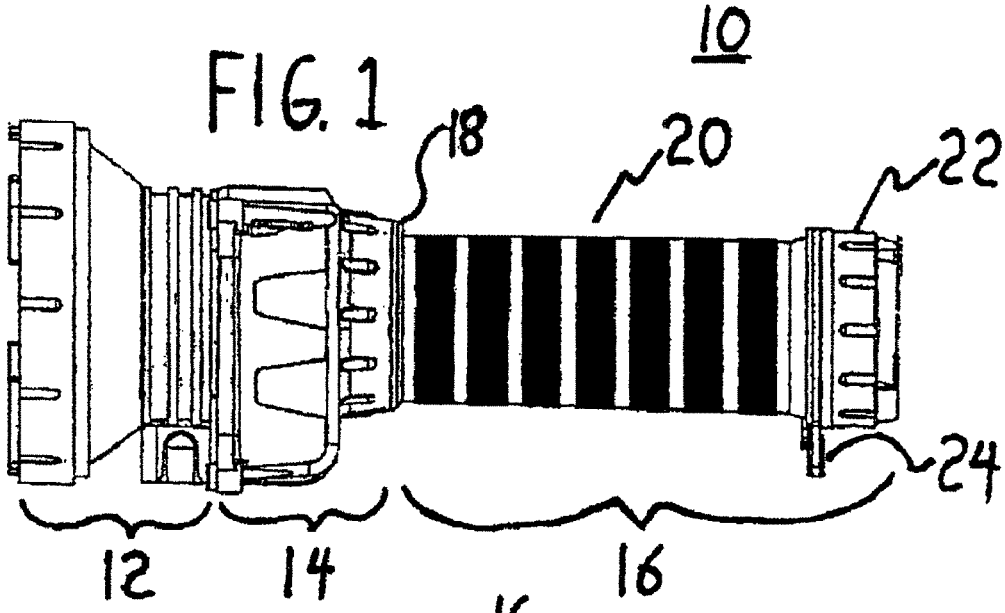
FIG. 1 is a side elevation view of a light in accordance with the present invention.
Figure 2:
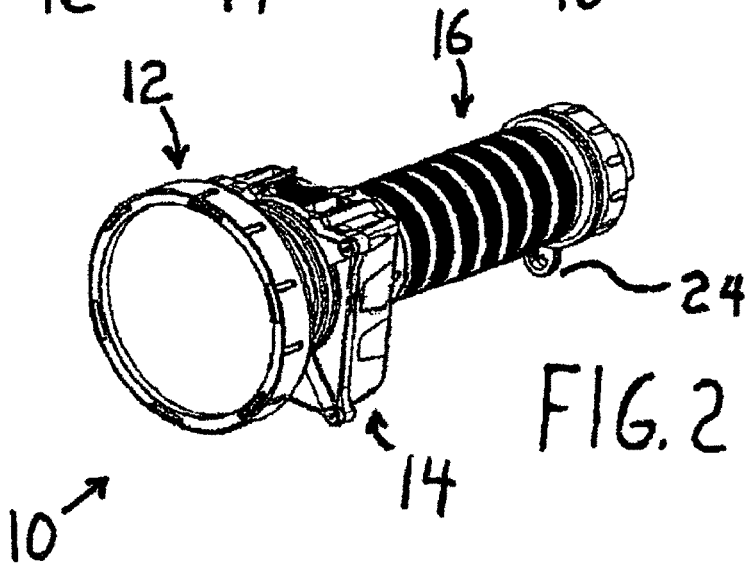
FIG. 2 is a perspective view of the light of FIG. 1.

An overall view of the portable lighting system 10 is illustrated in FIG. 1, which shows the lighting system 10 comprised of a lamp/reflector assembly 12, a ballast assembly 14, and a handle assembly 16. The handle assembly 16 includes a connector end 18 (where the handle assembly 16 is connected to the ballast assembly 14), a handgrip barrel 20, and a butt assembly 22. A D-ring connector 24 rotates about the handle assembly 16 between the handgrip barrel 20 and butt assembly 22. FIG. 2 provides a perspective view of lighting system 10 and the interconnection between the lamp/reflector assembly 12, the ballast assembly 14 and the handle assembly 16. FIG. 2 also provides a better view of D-ring connector 24.

Figure 5:
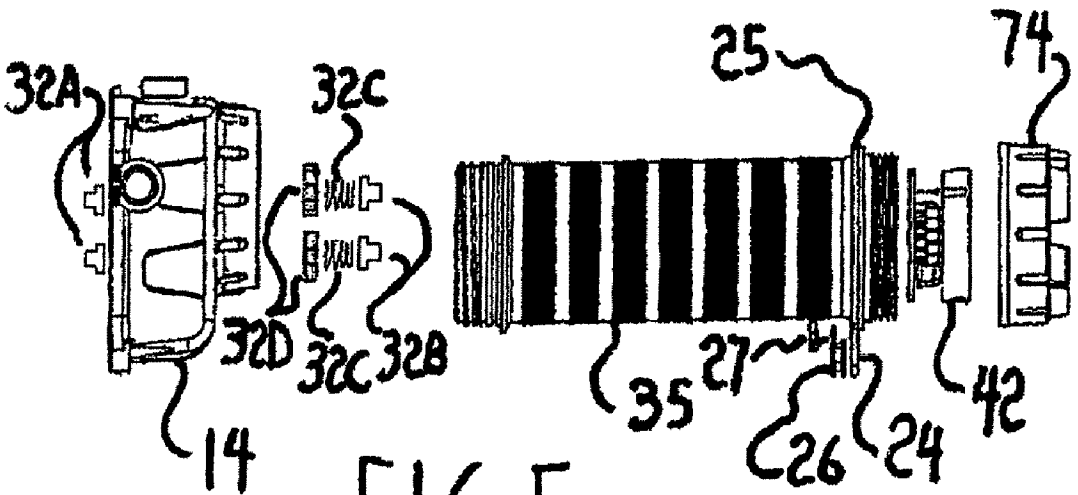
FIG. 5 is a partial, exploded perspective view of the handle, further illustrating a rotatable D-ring connecter in accordance with the present invention.

As further illustrated in FIG. 5, the D-ring 24 includes a circular ring component 25 that fits loosely around the end of the exterior handle case 35 so that the D-ring 24 can be rotated around the perimeter of the exterior handle case 35. This enables a user to attach a clip, such as a belt clip, to the D-ring 24 and wear the lighting system 10 at their waist. For example, a military combatant might attach the lighting system 10 to their personal rigging or "web" gear using the D-ring 24. A D-ring shaped rubber grommet 26 is fit within the opening of the D-ring 24 so any attached clip fits snuggly and no metal on metal contact is possible between the clip and the D-ring 24. Preventing metal on metal contact is important when the lighting system 10 is used in covert type operations where the user desires to make no noise whatsoever. Because noise can also be generated when the circular ring component 25 rotates around the exterior handle case 35, a locking mechanism 27 is also provided that enables the D-ring 24 to be locked in place against the exterior handle case 35 and prevent the circular ring component 25 of the D-ring 24 from coming off when handle end cap 74 is removed.

Figure 3:
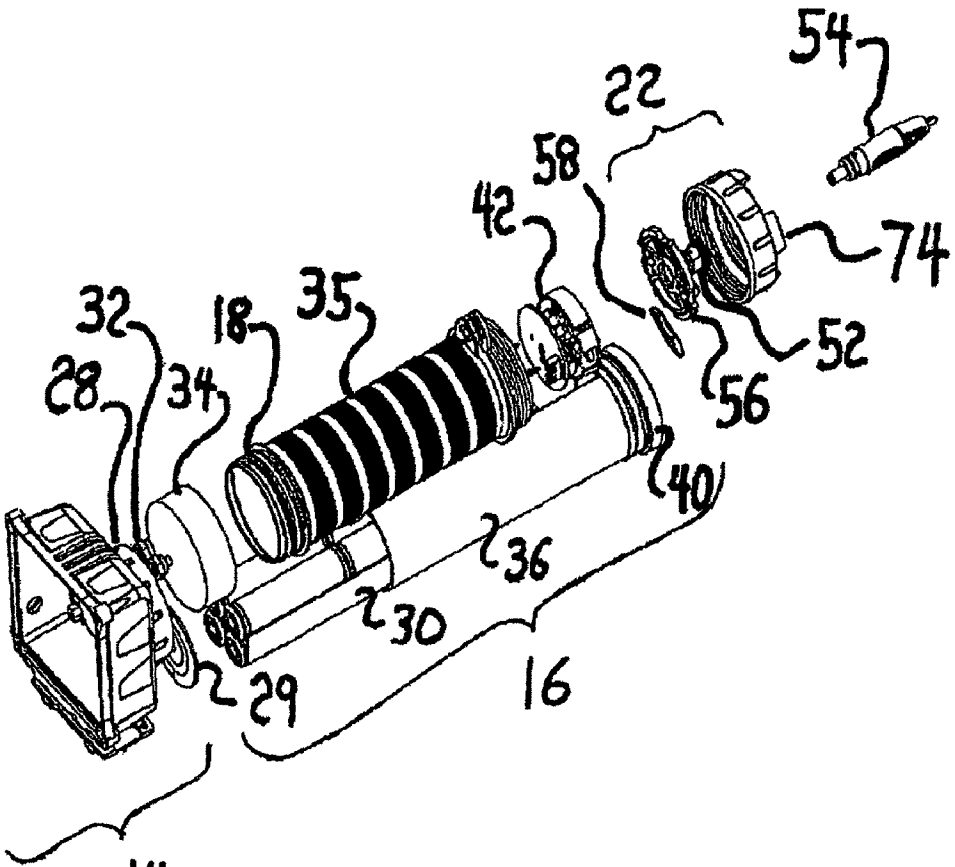
FIG. 3 is a partial, exploded perspective view of the light of FIG. 1, including a battery pack in accordance with the present invention.
Figure 4:
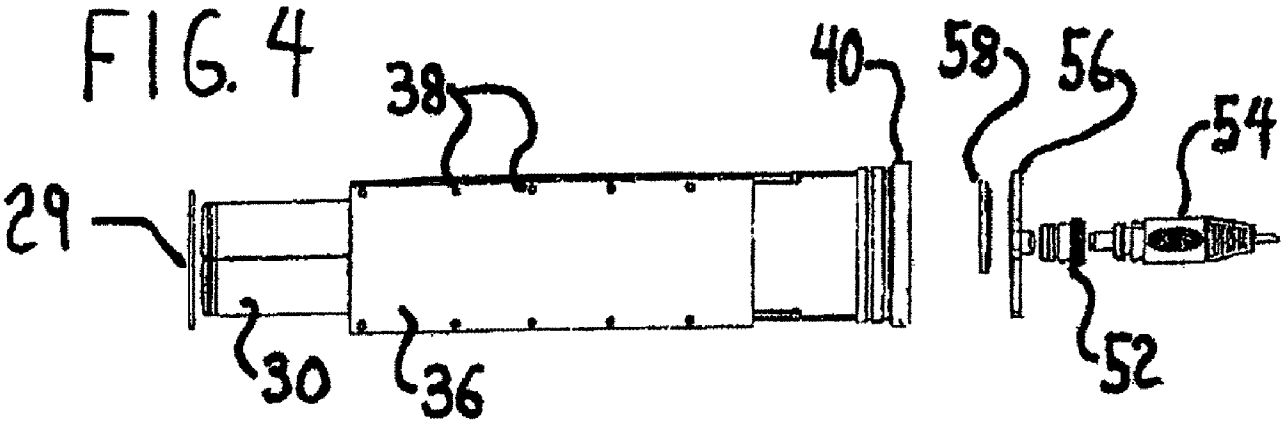
FIG. 4 is a partial, exploded side view of the inside of the battery pack of FIG. 3 and related components.

As the lamp/reflector assembly 12 and the ballast circuitry (not shown) inside the ballast assembly 14 are not significant to the present invention, FIGS. 3, 4 and 5 only provide partial, exploded perspective and side views of the ballast assembly 14 and the handle assembly 16, including some details of the inside of the handle assembly 16 and butt assembly 22. The handle assembly 16 forms a water-proof connection to the ballast assembly 14, when the threaded connector end 18 is inserted into a receiving end 28 of the ballast assembly 14. As will be further illustrated with reference to FIGS. 5 and 6 below, an electrical connection is made between conductor plate 29 of the batteries 30 and the connectors 32 of the ballast assembly 14 when the handle assembly 16 is fully inserted and secured to the ballast assembly 14.

The connectors 32, as illustrated in FIG. 5, are formed of coated or plated brass and comprised of end connectors 32A, which are formed within an interior wall (not shown) within the body of the ballast assembly 14. This interior wall forms a physical seal between the inside of the ballast assembly 14 and the handle assembly 16 and includes a metal plate formed within the wall (placed into an injection mold) that provides an electrical connectivity path between the end connectors 32A on the inside of the ballast assembly 14 and the other components of the connectors 32 on the outside of the ballast assembly 14. The end connectors 32A are attached to the metal plates and provide an electrical connection on the interior of the ballast assembly 14. On the outside of the ballast assembly 14, or the handle assembly 16 side, the connectors 32 are further comprised of plungers 32B, springs 32C, which fit within the plungers 32B, and locking nuts 32D, which fit over the plungers 32B and hold the plungers 32B and springs 32C in place against the exposed end of the end connectors 32A. When the handle assembly 6 is inserted into the ballast assembly 14, the anode and cathode of the conductor plate 29 make contact with and compress the plungers 32B to form solid, water-proof (sealed), electrical connections between the batteries and the ballast assembly 14.

Connectors 32 are preferably comprised of the components 32A-D so the portions of the components that make physical contact with the anode and cathode of the conductor plate 29 can be replaced when they begin to wear or should corrosion occur. If connectors 32 did not have these replaceable parts, or were otherwise configured, when the connectors 32 began to wear, the entire exterior of the ballast assembly 14 might have to be replaced, adding significant cost and introducing potential failure points when users, versus skilled technicians, attempted to repair the ballast assembly 14. Likewise, if the end connectors 32A were not formed into the interior wall, a hole would need to be made through the interior wall to enable a connection to be made between the batteries and the ballast assembly 14, and this hole could enable debris and water to enter the ballast assembly 14 and short its internal circuitry.

The conductor plates 29 are integrated into the seal cap 34 so as to form a water-proof electrical connection at one end of the handle assembly 16 between the batteries 30 and the ballast assembly 14. The battery assembly further includes the exterior handle case 35, within which the battery sleeve 36 is inserted. The entire handle assembly 16, with the batteries included, can be easily removed and replaced with another handle assembly 16 in a matter of seconds. This represents a significant improvement for lighting instruments, especially high intensity discharge lighting systems and other similar powerful lighting systems that are used in military and other types of stressful or covert operations.

The batteries 30 are preferably lithium ion batteries that are sealed and insulated from shock within the water-resistant plastic battery sleeve 36. Lithium ion batteries have one of the best energy-to-weight ratios for batteries, are rechargeable, are free of "memory" issues, have wide temperature range during use and storage, and are slow to lose charge when not in use. However, lithium ion batteries are more commonly used in consumer electronics and are not typically used in high intensity applications, such as the present invention.

As illustrated in FIG. 6, the sides of the battery sleeve 36 are preferably formed from two curved pieces of plastic, 36A and 36B, within which the batteries 30 are placed, and joined together by screws 38. On one end, these two curved pieces 36A and 36B fit into a clear plastic battery end cap 40, which also covers and insulates power indicator assembly 42. On the other end, the two curved pieces 36A and 36B come together and fit tightly around the sides of the conductor plate 29, which is formed from a central metal conductor 44, and an outer metal conductor 46, placed within a plastic mold 48. A number of O-rings (not shown) are placed on the outside of battery sleeve 36, one where the seal cap 34 is joined to the sleeve 36, and a number (3 pieces) at the opposite end of the battery sleeve 36 to further create a tight dust and water seal between the outside of the sleeve 36 and the interior of the exterior handle case 35.

The conductors 44 and 46 (the anode and cathode of the batteries) are rounded so as to enable a 360 degree physical and electrical connection to be formed between the conductors 44 and 46 and the conductors 32 when the handle assembly 16 is inserted and secured to the ballast assembly 14.

The battery end cap 40 has a central opening positioned over a connector, illustrated in FIG. 9. A recharge jack port or plug 52 is fit and adhered within the central opening (placed into an injection mold). The recharge jack port/plug 52 serves to guide and hold a push-down and twist (spring-loaded) bayonet type jack 54 which employs O-rings to insure a water-proof seal. The exterior surface of the battery end cap 40 is surrounded by a lip 50, illustrated in FIGS. 7, 8 and 9, which forms a seat for the moveable actuator 56 and tinted window 58.

The moveable actuator 56 has a central opening 60 that fits over recharge jack port/plug 52 and four spring clips 62 that fit within four detents 64 of the lip 50 to hold the actuator in one of four separate positions when rotated about the central opening 60. The moveable actuator 56 also has two window openings 66 and 68 and two finger nubs 70 and 72. The finger nubs 70 and 72 could be any type of shape or device that would enable a user to grip the moveable actuator 56 and rotate it in one direction or another.

When the actuator 56 is rotated, it activates lighting features within the end cap (as further described below), but it also self-cleans any debris that might have worked its way into the battery end cap 40 area. Debris that has lodged in the end cap area is collected by one or both of the window openings 66 and 68 and moved into exposure with the atmosphere, where it can be cleared away. Likewise, the use of dissimilar materials between the battery end cap 40 (including lip 50), made of Polycarbonate (for optical clarity and strength), and the moveable actuator 56, made of Polyacetal (for lubricity, spring strength, surface toughness and durability), causes debris to be caught between the end cap 40 and moveable actuator 56 and pushed away from the end cap area into exposure with the atmosphere, where it can be easily brushed or washed away. The materials of the end cap 40 and moveable actuator 56 can also be impregnated with Teflon (PTFE) and/or silicone, which will rise to the surface (at a molecular level) of the components as they are used and act as a natural lubricant.

The tinted window 58 could be fit within either of the window openings 66 or 68, with the remaining window opening left open, or fitted with a clear window. In the event both window openings are fitted with windows, the actuator would still be self-cleaning by pushing all debris to the lip 50. The windows would be made of plastic or glass, with tinted window 58 being darkly tinted. The finger nubs 70 and 72 could include small raised bumps or edges to improve the user's grip on the nubs. The operation of the moveable actuator 56 is more thoroughly described below with reference to FIGS. 8, 9 and 10.

Once the battery sleeve 36 and all of its components are inserted into the handle case 35, the D-ring 24 is inserted over the end of the handle case 35 and over an O-ring. The handle end cap 74 is then screwed onto the end of the exterior handle case 35 tightly enough to lock the D-ring in place and prevent it from making any kind of rattling noise.

Handle end cap 74 has a large central opening large enough for window openings 66 and 68 and finger nubs 70 and 72 to be accessible from the outside when the handle end cap 74 is in place, but small enough to otherwise hold the movable actuator 56 loosely in place (so it can be rotated). When the recharge jack plug 52 is not in use for recharging the batteries, a spring-loaded electrically inert end cap 75 (shown in FIGS. 8 and 9) with an O-ring seal would be inserted into the recharge jack plug 52.

The recharge jack port/plug 52 uses a bayonet type receptacle that requires either spring-loaded jack 54 or end cap 75 to be pushed down and twisted to lock the jack 54 or end cap 75 in place. The port/plug 52 has an end wall (not shown) with a hole in it that forms an access opening to the connector pin 77. The end wall is necessary to provide resistance against the ends of the spring-loaded jack 54 and the spring-loaded cap 75. The port/plug 52 also has an L-shaped locking slot 53 illustrated in FIG. 6. The jack 54 and end cap 75 include at least one small nub that protrudes from the side of the jack 54 and end cap 75 and mates with the locking slot 53. Preferably, the port/plug 52 includes two locking slots 53 on opposite sides and the jack 54 or end cap 75 has two nubs on opposite sides to match the two locking slots 53.

When the jack 54 or cap 75 is vertically inserted into the jack port/plug 52, the nub is vertically inserted into the locking slot. When the jack 54 or cap 75 hits the end wall, the spring within the jack 54 or cap 75 is depressed, enabling the jack 54 or cap 75 to be rotated clockwise to force the nub into the horizontal portion of the L-shaped locking slot 53. When the jack 54 or cap 75 is released, the spring of the jack 54 or cap 75 will force the nub against the upper portion of the L-shaped locking slot, which also includes a small lip that protrudes down and prevents the nub from easily sliding horizontally and being released. To remove the jack 54 or cap 75, the user would depress the spring, rotate the jack 54 or cap 75 counterclockwise, and pull the jack 54 or cap 75 out of the port/plug 52.

This feature ensures that the jack 54 will be completely inserted (to form a good electrical connection with connector pin 77, illustrated in FIG. 9) and cannot be accidently knocked loose while recharging. When the lighting system is used in military-like applications, it is critically important that the batteries 30 get recharged when intended.

This jack location also serves as a "line in" location for vehicle based, or "hard mounted" line power should the end user not desire to use the battery as the primary power source, but rather as back up for their available "line power" during extended or constant usage. Furthermore, the bayonet style "push down and turn" connection point guarantees that "line power" cords cannot accidentally "slip out" or become disconnected during the high stress of combat situations. Everyday use in extreme environments, like waterborne operations are aided by the bayonet jack's stainless steel construction with an internal geometry set to receive O-rings from the line power cord's plug, or that of the charger's plug. When connected to "line power," the jack and its location serve two purposes: as an input for an alternate "primary source" of power, and as a continued "trickle charge" port (to keep the battery at a full charge) when the lamp is not in use.

Likewise, ensuring that the end cap is locked in place and not capable of being accidently discharged makes certain that water and other foreign elements do not foul the inside of the power indicator assembly 42. Even if the end cap were to be left open, (exposing the inner jack port and the power indicator assembly 42) and the handle assembly 6 was submerged in water, the power indicator assembly 42 will not short electrically, or allow fluids to pass. This was accomplished by coating and individually sealing the printed circuit boards within the power indicator assembly 42 as a back-up measure. The redundant nature of the battery pack makes the lighting system tough, resilient, and flexible, which allows it to be a good tool in rugged environments.

An O-ring seal on the end cap 75 further improves the seal created by the end cap. Also, so the end cap cannot be easily lost when the batteries 30 are being recharged, a flexible retaining wire can be connected to the end cap 75 and one of the finger nubs 70 or 72. When the end cap 75 is removed, the flexible retaining wire keeps the end cap 75 in close proximity to the recharge jack plug 52 without getting lost.

As shown in FIGS. 8, 9 and 10, the power indicator assembly 42 includes electronics for the control and operation of the three illuminator LEDs 76 and the battery power indicator LEDs 78 mounted therein. The illuminator LEDs 76 are preferably high intensity LEDs that are capable of producing sufficient light (but much less than the main HID lamp) to enable a user of the lighting system to read a map or be able to move around in the dark. The battery power indicator LEDs 78 do not need to be high intensity LEDs and only need to be able to produce enough light to be visible when covered with the tinted window 58. The illuminator LEDs 76 and battery power indicator LEDs 78 fit into illuminator openings 80 and 82, respectively of the indicator base 84.

As illustrated herein, there are five battery power indicator LEDs 76, which enables the power indicator assembly 42, working in conjunction with a real-time battery power monitoring system (not shown), to display different levels of battery power. For example, one LED 76 could be green, to indicate full power. Two more LEDs 76 could be yellow, to indicate less than full power. One additional LED 76 could be orange to indicate low power, and a fifth LED 76 could be red to indicate dangerously low power, which when activated in the last five minutes of its useable run time, flashes to indicate the necessity of a battery change, and the impending battery shut down. Many other arrangements are clearly possible.

The moveable actuator 56 has a magnet positioned under each of the finger nubs 70 and 72. These magnets serve to activate a reed switch within the power indicator assembly 42 (not shown). When the moveable actuator 56 is rotated in either direction, one of the magnets passes over the reed switch and causes it to activate either the illuminator LEDs 76 or the battery power indicator LEDs 78. Since the window openings 66 or 68 are positioned opposite the finger nubs 70 and 72, rotation of the magnets over the reed switch causes the LEDs 76 or 78 to turn on when one of the window openings 66 or 68 is positioned over them.

Thus, when window opening 66 is positioned over illuminator LEDs 76, illuminator LEDs 76 are activated. Likewise, if window opening 68 is positioned over battery power indicator LEDs 78, indicator LEDs 78 are activated. Since the window openings 66 and 68 are positioned opposite one another, but the groupings of LEDs 76 and 78 are adjacent one another, as portrayed by the position of the illuminator openings 80 and 82 in FIGS. 10A and 10B, only one grouping of LEDs 76 or 78 can be illuminated at one time. Also, because one of the window openings 66 or 68 is open or covered with clear material, while the other is covered with a filtered material, the moveable actuator, in combination with the LEDs 76 and 78, are able to perform four separate functions.

One function is to provide bright unfiltered light. A second function is to provide bright filtered light, which is necessary in certain covert type operations. A third function is to provide an unfiltered battery power indication. The fourth function is to provide a filtered battery power indication, which again is necessary in covert type operations. Careful operation of this four function switch is required to prevent the unfiltered illuminator LEDs 76 or the unfiltered barrier power indicator LEDs 78 from being turned on in covert operations.

Figure 11:
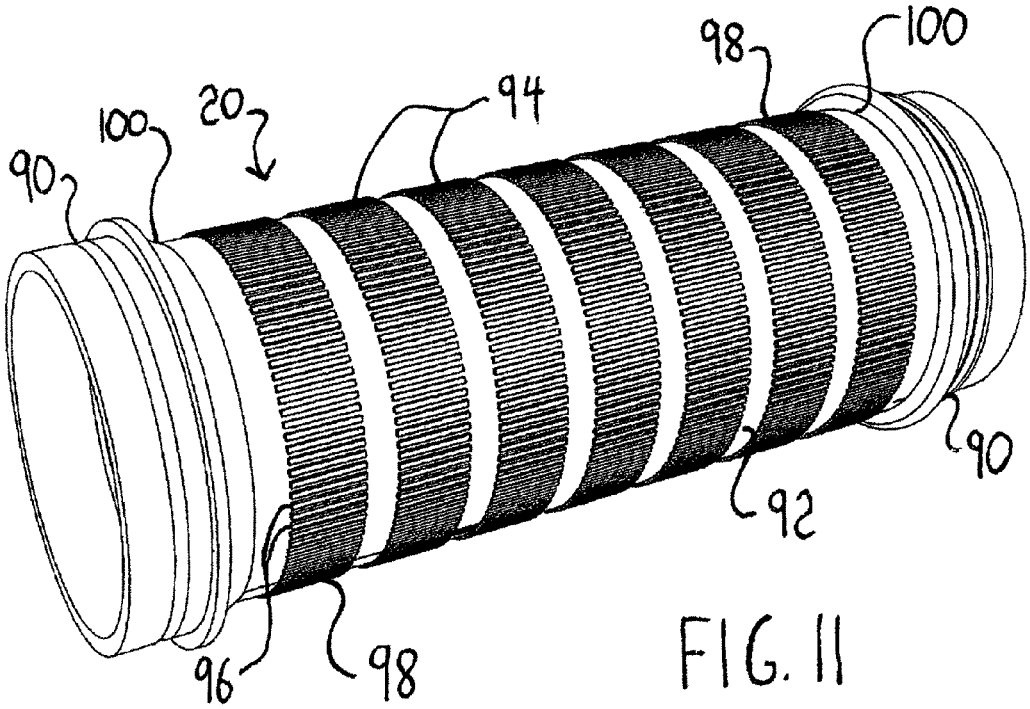
FIG. 11 illustrates the handgrip barrel and knurling system of the present invention.

As illustrated in FIG. 11, the handgrip barrel 20 forms an outer surface that can be gripped by the hand of a user of the lighting system 10. The handgrip barrel 20 has a base outer diameter in the 50-60 mm range, which is generally considered by occupational health and safety officials as the appropriate diameter for tools requiring a user to apply greater torque. The end of the handgrip barrel 20 includes a number of grooves 90 for holding O-rings with firm compression that generate significant resistance when the handle assembly 16 is attached to or detached from the ballast assembly 14. In the preferred embodiment of the present invention, the substantially smooth base 92 has an outer diameter of 52 mm. This outer diameter, with the 53 mm knurl rings described below, was selected after significant testing in different temperature ranges and different surface debris conditions. The selection of these dimensions resulted in a handgrip barrel 20 that was comfortable and easy to use, without making the handle unnecessarily large; and therefore, unwieldy for field use and transport.

A series of slightly raised, spaced-apart, knurl rings 94, preferably having an outer diameter of 53 mm, are formed around the handgrip barrel 20. A long handgrip barrel 20, such as that shown in FIG. 1, would preferably have six to eight knurl rings 94, while a smaller handle may only have three or four knurl rings 94. The knurling pattern could be any number of patterns, such as a diamond-shaped (criss-cross) pattern, but the preferable pattern is a series of straight ridges 96 (each between 1 mm to 2 mm in width), the length of which are parallel to the length of handgrip barrel 20. While the width of each ridge 96 and ring 94, and the spacing between the ridges 96 and rings 94, are not too critical, each ring 94 is preferably between 12 mm to 13 mm in width and the spacing between the rings 94 is approximately 5 mm. The spacing between the outer rings 98 on the handgrip barrel 20 and the ends 100 of the handgrip barrel 20 can range from 5 mm to 10 mm.

The spaced-apart knurl rings 94 and straight ridge pattern are preferable for a number of reasons. First, they provide the user with maximum grip in the direction of necessary torque (i.e. the clockwise/counterclockwise motion of screwing/unscrewing the handgrip barrel 20), while offering sufficient variation between the "high and low" areas to make the product difficult to pull out of the hand in an axial fashion. The torque of screwing requires a more exacting "grip" or "traction," while axial "pull" requires greater contrast across the overall surface area for a better "purchase" on the entire handle. The preferred embodiment of the handgrip barrel 20, with the knurling system described above, is ideal for both functions.

Second, military products are generally required to have surfaces that do not collect debris or get easily clogged, which can lead to a loss of grip. This is especially important for any product used in combat situations, where it may be necessary for a combatant to use the lighting system as a back-up striking weapon. The military also wants such products to be easily cleaned. The preferred embodiment of the handgrip barrel 20, with the knurling system, meets both military requirements.

While the present invention has been illustrated and described herein in terms of a preferred embodiment and several alternatives associated with a handheld HID lighting system for use in visible and covert operations, it is to be understood that the various components of the combination and the combination itself can have a multitude of additional uses and applications. For example, the lamp 10 could be used in lighting systems mounted to a variety of vehicles including military vehicles, vessels, aircraft, and automobiles and could be used in many other commercial, scientific, law enforcement, security, and military-type operations. Accordingly, the invention should not be limited to just the particular description and various drawing figures contained in this specification that merely illustrate a preferred embodiment and application of the principles of the invention.

What is claimed is:

1. A handgrip for a portable device, comprising:

a substantially cylindrical handle including an outer surface having a first outer diameter of approximately 50 mm to 60 mm; and a plurality of rings that cylindrically surround the handle and extend approximately 1 mm from the outer surface, the plurality of rings being arranged on the outer surface so as to create a gap between each ring of the plurality of rings, each gap including an outer diameter approximately equal to the first outer diameter, each ring of the plurality of rings including a ring surface having a knurling pattern formed thereon that substantially resists collecting debris, the handle in combination with the plurality of rings enabling a user to exert a substantial torque force when the handgrip is rotated and to withstand a substantial axial force when the handgrip is pulled away from the user.

2. The handgrip as recited in claim 1, wherein the knurling pattern is formed from a series of ridges with a ridge gap formed between each ridge of the series of ridges, each ridge having a length that runs parallel to an axis of the handle.

3. The handgrip as recited in claim 2, wherein each ridge has a width of approximately 1 mm to 2 mm and each ring of the plurality of rings has a width of approximately 12 mm to 13 mm.

4. The handgrip as recited in claim 3, wherein each gap is approximately 5 mm.

5. The handgrip as recited in claim 4, wherein the outer surface is substantially smooth.

6. The handgrip as recited in claim 3, wherein the outer surface is substantially smooth.

7. The handgrip as recited in claim 1, wherein the knurling pattern is formed from a series of diamond-shaped cuts in the ring surface of each ring of the plurality of rings.

8. The handgrip as recited in claim 1, wherein the first outer diameter is approximately 52 mm.

9. The handgrip as recited in claim 1, wherein the plurality of rings includes between three and eight rings.

10. The handgrip as recited in claim 1, wherein each ring of the plurality of rings has a width of approximately 12 mm to 13 mm.

11. The handgrip as recited in claim 1, wherein the outer surface is substantially smooth.

12. The handgrip as recited in claim 1, wherein the handle has a first end and a second end, wherein a first end ring of the plurality of rings is spaced approximate 5 mm to 10 mm from the first end, and wherein a second end ring of the plurality of rings is spaced approximate 5 mm to 10 mm from the second end.

13. The handgrip as recited in claim 1, wherein each gap is approximately 5 mm.

14. The handgrip as recited in claim 1, wherein the portable device is a lighting system.

15. A handgrip for a portable lighting system, comprising:

a substantially cylindrical handle including a substantially smooth outer surface having a first outer diameter of approximately 52 mm; and a plurality of rings that cylindrically surround the handle and extend approximately 1 mm from the outer surface, each ring of the plurality of rings having a width of approximately 12 mm to 13 mm, the plurality of rings being arranged on the outer surface so as to create a gap of approximately 5 mm between each ring of the plurality of rings, each gap including an outer diameter approximately equal to the first outer diameter, each ring of the plurality of rings including a ring surface having a knurling pattern formed thereon that substantially resists collecting debris, the handle in combination with the plurality of rings enabling a user to exert a substantial torque force when the handgrip is rotated and to withstand a substantial axial force when the handgrip is pulled away from the user.

16. The handgrip as recited in claim 15, wherein the knurling pattern is formed from a series of ridges with a ridge gap formed between each ridge of the series of ridges, each ridge having a length that runs parallel to an axis of the handle and a width of approximately 1 mm to 2 mm.

17. The handgrip as recited in claim 16, wherein the plurality of rings includes between three and eight rings.

18. The handgrip as recited in claim 16, wherein the handle has a first end and a second end, wherein a first end ring of the plurality of rings is spaced approximate 5 mm to 10 mm from the first end, and wherein a second end ring of the plurality of rings is spaced approximate 5 mm to 10 mm from the second end.

19. The handgrip as recited in claim 15, wherein the knurling pattern is formed from a series of diamond-shaped cuts in the ring surface of each ring of the plurality of rings.

20. The handgrip as recited in claim 19, wherein the plurality of rings includes between three and eight rings.

21. The handgrip as recited in claim 19, wherein the handle has a first end and a second end, wherein a first end ring of the plurality of rings is spaced approximate 5 mm to 10 mm from the first end, and wherein a second end ring of the plurality of rings is spaced approximate 5 mm to 10 mm from the second end.

22. The handgrip as recited in claim 15, wherein the plurality of rings includes between three and eight rings.

23. The handgrip as recited in claim 15, wherein the handle has a first end and a second end, wherein a first end ring of the plurality of rings is spaced approximate 5 mm to 10 mm from the first end, and wherein a second end ring of the plurality of rings is spaced approximate 5 mm to 10 mm from the second end.

24. A handgrip for a portable device, comprising:

a substantially cylindrical handle including an outer surface having a first outer diameter of approximately 50 mm to 60 mm; and a plurality of rings that cylindrically surround the handle and extend approximately 1 mm from the outer surface, the plurality of rings being arranged on the outer surface so as to create a gap between each ring of the plurality of rings, each gap including an outer diameter approximately equal to the first outer diameter, each ring of the plurality of rings including a ring surface having a series of ridges formed thereon with a ridge gap formed between each ridge of the series of ridges, each ridge having a length that runs parallel to an axis of the handle and a width of approximately 1 mm to 2 mm, the handle in combination with the plurality of rings enabling a user to exert a substantial torque force when the handgrip is rotated and withstand a substantial axial force when the handgrip is pulled away from the user.

25. The handgrip as recited in claim 24, wherein the first outer diameter is approximately 52 mm.

26. The handgrip as recited in claim 24, wherein the plurality of rings includes between three and eight rings.

27. The handgrip as recited in claim 26, wherein each ring of the plurality of rings has a width of approximately 12 mm to 13 mm.

28. The handgrip as recited in claim 26, wherein the gap is approximately 5 mm.

29. The handgrip as recited in claim 24, wherein each ring of the plurality of rings has a width of approximately 12 mm to 13 mm.

30. The handgrip as recited in claim 24, wherein the outer surface is substantially smooth.

31. The handgrip as recited in claim 24, wherein the handle has a first end and a second end, wherein a first end ring of the plurality of rings is spaced approximate 5 mm to 10 mm from the first end, and wherein a second end ring of the plurality of rings is spaced approximate 5 mm to 10 mm from the second end.

32. The handgrip as recited in claim 24, wherein the gap is approximately 5 mm.

33. The handgrip as recited in claim 24, wherein the portable device is a lighting system.

* * * * *